US008187780B2

(12) United States Patent
McAneney-Lannen et al.

(10) Patent No.: US 8,187,780 B2
(45) Date of Patent: May 29, 2012

(54) TONER COMPOSITIONS AND PROCESSES

(75) Inventors: Gwynne McAneney-Lannen, Waterdown (CA); Guerino G. Sacripante, Oakville (CA); Edward G. Zwartz, Mississauga (CA); Maria N. V. McDougall, Oakville (CA)

(73) Assignee: Xerox Corporation, Norwalk, CT (US)

( * ) Notice: Subject to any disclaimer, the term of this patent is extended or adjusted under 35 U.S.C. 154(b) by 883 days.

(21) Appl. No.: 12/255,405

(22) Filed: Oct. 21, 2008

(65) Prior Publication Data

US 2010/0099037 A1 Apr. 22, 2010

(51) Int. Cl.
*G03G 9/093* (2006.01)

(52) U.S. Cl. ..... 430/110.2; 430/109.4; 430/108.4

(58) Field of Classification Search ..... 430/110.2, 430/109.4, 108.4
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 4,295,990 | A | 10/1981 | Verbeek et al. |
| 4,298,672 | A | 11/1981 | Lu |
| 4,338,390 | A | 7/1982 | Lu |
| 4,935,326 | A | 6/1990 | Creatura et al. |
| 4,937,166 | A | 6/1990 | Creatura et al. |
| 5,004,664 | A | 4/1991 | Fuller et al. |
| 5,236,629 | A | 8/1993 | Mahabadi et al. |
| 5,278,020 | A | 1/1994 | Grushkin et al. |
| 5,290,654 | A | 3/1994 | Sacripante et al. |
| 5,302,486 | A | 4/1994 | Patel et al. |
| 5,308,734 | A | 5/1994 | Sacripante et al. |
| 5,330,874 | A | 7/1994 | Mahabadi et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,925,488 | A | 7/1999 | Patel et al. |
| 5,959,066 | A | 9/1999 | Charbonneau et al. |
| 5,977,210 | A | 11/1999 | Patel et al. |
| 5,994,020 | A | 11/1999 | Patel et al. |
| 6,025,061 | A | 2/2000 | Khanarian et al. |
| 6,063,464 | A | 5/2000 | Charbonneau et al. |
| 6,107,447 | A | 8/2000 | Kreuder et al. |
| 6,120,967 | A | 9/2000 | Hopper et al. |
| 6,214,507 | B1 | 4/2001 | Sokol et al. |
| 6,635,782 | B2 | 10/2003 | Honma et al. |
| 6,645,743 | B1 | 11/2003 | Honma et al. |
| 6,649,381 | B1 | 11/2003 | Honma et al. |
| 6,777,153 | B2 | 8/2004 | Yano et al. |
| 6,808,854 | B2 | 10/2004 | Imamura et al. |
| 6,828,074 | B2 | 12/2004 | Yano et al. |
| 6,853,477 | B2 | 2/2005 | Nomoto et al. |
| 6,855,472 | B2 * | 2/2005 | Imamura et al. ..... 430/109.4 |
| 6,858,367 | B2 | 2/2005 | Yano et al. |
| 6,908,720 | B2 | 6/2005 | Kenmoku et al. |
| 6,908,721 | B2 | 6/2005 | Kenmoku et al. |
| 6,911,520 | B2 | 6/2005 | Fukui et al. |
| 7,045,321 | B2 | 5/2006 | Imamura et al. |
| 7,393,912 | B2 | 7/2008 | Mihara et al. |
| 7,408,017 | B2 | 8/2008 | Imamura et al. |
| 7,547,499 | B2 | 6/2009 | Veregin et al. |
| 7,645,549 | B2 | 1/2010 | Vijayendran et al. |
| 7,785,763 | B2 | 8/2010 | Agur et al. |
| 7,858,285 | B2 | 12/2010 | Sacripante et al. |
| 7,887,982 | B2 | 2/2011 | Vijayendran et al. |
| 7,943,283 | B2 | 5/2011 | Lai et al. |
| 2005/0074685 | A1 * | 4/2005 | Kido et al. ..... 430/110.2 |
| 2006/0287473 | A1 | 12/2006 | Fukui et al. |
| 2008/0145775 | A1 * | 6/2008 | Vijayendran et al. ..... 430/109.3 |
| 2009/0105377 | A1 * | 4/2009 | Vijayendran et al. ..... 524/88 |
| 2009/0155703 | A1 | 6/2009 | Sacripante et al. |

FOREIGN PATENT DOCUMENTS

| | | |
|---|---|---|
| EP | 0 615 166 | 9/1994 |

(Continued)

OTHER PUBLICATIONS

Canadian Patent Office, Office Action mailed May 26, 2011 in Canadian Patent Application No. 2,682,456.

European Search Report for EP 09 17 2848 dated Feb. 2, 2010.

Corinna Wu, Weight control for bacterial plastic—study manipulates bacteria enzymes to produce biopolymers with larger molecules—Brief Article; Jan. 11, 1997.

Lenz et al.; Bacterial Polyesters: Biosynthesis, Biodegradable Plastics and Biotechnology, Bio-Macromolecules: The American Chemical Society, 8 pages, vol. 6, No. 1, (Jan./Feb. 2005).

*Primary Examiner* — Christopher Rodee
(74) *Attorney, Agent, or Firm* — Oliff & Berridge, PLC

(57) ABSTRACT

Environmentally friendly toner particles are provided which may, in embodiments, include a biodegradable semi-crystalline polyester resin and a biodegradable amorphous polyester resin.

13 Claims, No Drawings

FOREIGN PATENT DOCUMENTS

| | | | | |
|---|---|---|---|---|
| EP | 1 253 475 | | | 10/2002 |
| EP | 1253475 | A2 | * | 10/2002 |
| EP | 1254918 | A2 | * | 11/2002 |
| EP | 1 956 436 | | | 8/2008 |
| JP | A-03-180186 | | | 8/1991 |
| JP | A-07-079787 | | | 3/1995 |
| JP | A-07-255466 | | | 10/1995 |
| JP | A-2001-316462 | | | 11/2001 |
| JP | A-2003-047494 | | | 2/2003 |
| JP | A-2003-048968 | | | 2/2003 |
| JP | A-2005-097633 | | | 4/2005 |
| JP | A-2007-014300 | | | 1/2007 |
| WO | WO 2006/102279 | A2 | | 9/2006 |
| WO | WO 2007/023145 | A2 | | 3/2007 |
| WO | WO 2008/031592 | A1 | | 3/2008 |

* cited by examiner

TONER COMPOSITIONS AND PROCESSES

CROSS REFERENCE TO RELATED APPLICATIONS

The present application relates to co-pending U.S. patent application Ser. No. 11/956,878, U.S. Publication No. 20090155703, filed Dec. 14, 2007, entitled Toner Composition and Process, the disclosure of which is hereby incorporated by reference in its entirety.

TECHNICAL FIELD

The present disclosure relates to toner compositions and toner processes, such as emulsion aggregation processes as well as toner compositions formed by such processes. More specifically, the present disclosure relates to emulsion aggregation processes utilizing a bio-based amorphous and semi-crystalline polyester resin.

BACKGROUND

Numerous processes are within the purview of those skilled in the art for the preparation of toners. Emulsion aggregation (EA) is one such method. Emulsion aggregation toners may be used in forming print and/or xerographic images. Emulsion aggregation techniques may involve the formation of an emulsion latex of the resin particles, by heating the resin, using an emulsion polymerization, as disclosed in, for example, U.S. Pat. No. 5,853,943, the disclosure of which is hereby incorporated by reference in its entirety. Other examples of emulsion/aggregation/coalescing processes for the preparation of toners are illustrated in U.S. Pat. Nos. 5,278,020, 5,290,654, 5,302,486, 5,308,734, 5,344,738, 5,346,797, 5,348,832, 5,364,729, 5,366,841, 5,370,963, 5,403,693, 5,405,728, 5,418,108, 5,496,676, 5,501,935, 5,527,658, 5,585,215, 5,650,255, 5,650,256, 5,723,253, 5,744,520, 5,763,133, 5,766,818, 5,747,215, 5,804,349, 5,827,633, 5,840,462, 5,853,944, 5,869,215, 5,863,698; 5,902,710; 5,910,387; 5,916,725; 5,919,595; 5,925,488, 5,977,210, 5,994,020, and U.S. Patent Application Publication No. 2008/01017989, the disclosures of which are hereby incorporated by reference in its entirety.

Polyester EA ultra low melt (ULM) toners have been prepared utilizing amorphous and crystalline polyester resins as illustrated, for example, in U.S. Patent Application Publication No. 2008/0153027, the disclosure of which is hereby incorporated by reference in its entirety.

Two exemplary emulsion aggregation toners include acrylate based toners, such as those based on styrene acrylate toner particles as illustrated in, for example, U.S. Pat. No. 6,120,967, and polyester toner particles, as disclosed in, for example, U.S. Pat. No. 5,916,725, U.S. Patent Application Publication Nos. 2008/0090163 and 2008/0107989, the disclosures of each of which is hereby incorporated by reference in their entirety. Another example, as disclosed in co-pending U.S. patent application Ser. No. 11/956,878, includes a toner having particles of a biobased resin, such as, for example, a semi-crystalline biodegradable polyester resin including polyhydroxyalkanoates, wherein the toner is prepared by an emulsion aggregation process.

The vast majority of polymeric materials are based upon the extraction and processing of fossil fuels, leading ultimately to increases in greenhouse gases and accumulation of non-degradable materials in the environment. Furthermore, some current polyester based toners are derived from bisphenol A, which is a known carcinogen/endocrine disrupter. It is highly likely that greater public restrictions on the use of this chemical will be enacted in the future. Thus alternative, cost-effective, environmentally friendly, polyesters remain desirable.

SUMMARY

Emulsion aggregation toner compositions and emulsion aggregation processes for preparing toner compositions are described. A toner is provided which includes at least one biodegradable semi-crystalline polyester resin; at least one bio-based amorphous polyester resin; and optionally, one or more ingredients selected from the group consisting of colorants, waxes, coagulants, and combinations thereof.

The at least one biodegradable semi-crystalline polyester resin may include a semi-crystalline polyhydroxyalkanoate (PHA) resin having the formula:

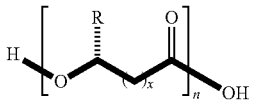

wherein R is H, a substituted alkyl group, or an unsubstituted alkyl group having from about 1 to about 13 carbon atoms, X is from about 1 to about 3, and n is from about 50 to about 10,000. The amorphous biobased polyester resin may be derived from a bio-based material selected from the group consisting of polylactide, polycaprolactone, polyesters derived from D-Isosorbide, polyesters derived from a fatty dimer diol, polyesters derived from a dimer diacid, L-tyrosine, glutamic acid, and combinations thereof.

In one aspect, a toner is provided having at least one biodegradable semi-crystalline polyester resin including a polyhydroxyalkanoate selected from the group consisting of polyhydroxybutyrate, polyhydroxyvalerate, copolyesters containing randomly arranged units of 3-hydroxybutyrate and 3-hydroxyvalerate, and combinations thereof; at least one bio-based amorphous polyester resin derived from a bio-based material selected from the group consisting of polylactide, polycaprolactone, polyesters derived from D-Isosorbide, polyesters derived from a fatty dimer diol, polyesters derived from a dimer diacid, L-tyrosine, glutamic acid, and combinations thereof; and optionally, one or more ingredients selected from the group consisting of colorants, waxes, coagulants, and combinations thereof.

An emulsion aggregation process is also provided for preparing a toner of the present disclosure and includes the steps of contacting a semi-crystalline biodegradable polyester resin with an amorphous biodegradable polyester resin in an emulsion, contacting the emulsion with an optional colorant dispersion, an optional wax, and an optional coagulant to form a mixture; aggregating small particles in the mixture to form a plurality of larger aggregates; coalescing the larger aggregates to form toner particles; and recovering the particles.

DETAILED DESCRIPTION

The present disclosure provides toner processes for the preparation of toner compositions, as well as toners produced by these processes. In embodiments, toners may be produced by a chemical process, such as emulsion aggregation, wherein a mixture of amorphous and semi-crystalline polyester resins, are aggregated, optionally with a wax and a colorant, in the presence of a coagulant, and thereafter stabilizing the aggregates and coalescing or fusing the aggregates such as by heating the mixture above the resin Tg to provide toner sized particles. Also, disclosed is a toner comprised of a core of at least one biodegradable semi-crystalline polyester resin of a polyhydroxyalkanoate selected from the group consisting of polyhydroxybutyrate, polyhydroxyvalerate, copolyesters containing randomly arranged units of 3-hydroxybutyrate and 3-hydroxyvalerate, and combinations thereof; and at least one bio-based amorphous polyester resin derived from a bio-based material selected from the group consisting of polylactide, polycaprolactone, polyesters derived from D-Isosorbide, polyesters derived from a fatty dimer diol, polyesters derived from a dimer diacid, L-tyrosine, glutamic acid, and combinations thereof; and a shell present on the core, and which shell comprises said biodegradable semi-crystalline polyester resin, said bio-based amorphous polyester resin, or mixtures thereof; and one or more ingredients selected from the group consisting of colorants, waxes, coagulants, and combinations thereof.

In embodiments, an unsaturated polyester resin may be utilized as a latex resin. The latex resin may be either crystalline, amorphous, or a mixture thereof. Thus, for example, the toner particles can include a crystalline latex polymer, a semi-crystalline latex polymer, an amorphous latex polymer, or a mixture of two or more latex polymers, where one or more latex polymer is crystalline and one or more latex polymer is amorphous. In embodiments, toner particles of the present disclosure may possess a core-shell configuration.

Core Resins

In embodiments, polymers which may be utilized to form the resin for a toner of the present disclosure, including a core, may be a biodegradable polyester resin. Examples of such resins include crystalline and/or semi-crystalline resins, including the resins described in co-pending U.S. patent application Ser. No. 11/956,878. In embodiments, the toner may include particles of a bio-based resin, for example, a semi-crystalline biodegradable polyester resin such as a polyhydroxyalkanoate, wherein the toner is prepared by an emulsion aggregation process. Other examples of toners utilizing biodegradable polyester resins produced by other processes include those disclosed in U.S. Pat. Nos. 7,408,017; 7,393,912; 7,045,321; 6,911,520; 6,908,721; 6,908,720; 6,858,367; 6,855,472; 6,853,477; 6,828,074; 6,808,854; 6,777,153; 6,645,743; 6,635,782; 6,649,381; 5,004,664; and U.S. Patent Application Publication Nos. 2007/0015075 and 2008/0145775, the disclosure of each of which are hereby incorporated by reference in their entirety.

Examples of semi-crystalline resins which may be utilized include polyesters, polyamides, polyimides, polyisobutyrate, and polyolefins such as polyethylene, polybutylene, ethylene-propylene copolymers, ethylene-vinyl acetate copolymers, polypropylene, combinations thereof, and the like. In embodiments, semi-crystalline resins which may be utilized may be polyester based, such as polyhydroxyalkanoates having the formula:

(I)

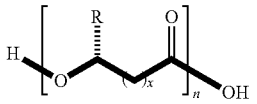

wherein R is independently H or a substituted or unsubstituted alkyl group of from about 1 to about 13 carbon atoms, in embodiments, from about 3 to about 10 carbon atoms, X is from about 1 to about 3, and n is a degree of polymerization of from about 50 to about 20,000, in embodiments, from about 100 to about 15,000.

In embodiments, R can be substituted with groups such as, for example, silyl groups; nitro groups; cyano groups; halide atoms, such as fluoride, chloride, bromide, iodide, and astatide; amine groups, including primary, secondary, and tertiary amines; hydroxy groups; alkoxy groups, such as those having from about 1 to about 20 carbon atoms, in embodiments, from about 2 to about 10 carbon atoms; aryloxy groups, such as those having from about 6 to about 20 carbon atoms, in embodiments, from about 6 to about 10 carbon atoms; alkylthio groups, such as those having from about 1 to about 20 carbon atoms, in embodiments, from about 1 to about 10 carbon atoms; arylthio groups, such as those having from about 6 to about 20 carbon atoms, in embodiments, from about 6 to about 10 carbon atoms; aldehyde groups; ketone groups; ester groups; amide groups; carboxylic acid groups; sulfonic acid groups; combinations thereof and the like.

Suitable polyhydroxyalkanoate resins include polyhydroxybutyrate (PHB), polyhydroxyvalerate (PHV) and copolyesters containing randomly arranged units of 3-hydroxybutyrate (HB) and/or 3-hydroxyvalerate (HV), such as, poly-beta-hydroxybutyrate-co-beta-hydroxyvalerate, and combinations thereof. Other suitable polyhydroxyalkanoate resins are described, for example, in U.S. Pat. No. 5,004,664, the disclosure of which is hereby incorporated by reference in its entirety.

Polyhydroxyalkanoate resins may be obtained from any suitable source, such as, by a synthetic process, as described in U.S. Pat. No. 5,004,664, or by isolating the resin from a microorganism capable of producing the resin. Examples of microorganisms that are able to produce polyhydroxyalkanoate resins include, for example, *Alcaligenes eutrophus, Methylobacterium* sp., *Paracoccus* sp., *Alcaligenes* sp., *Pseudomonas* sp., *Comamonas acidovorans* and *Aeromonas caviae* as described, for example in Robert W. Lenz and Robert H. Marchessault, Macromolecules, Volume 6, Number 1, pages 1-8 (2005), Japanese Patent Publication No. 2005-097633, Japanese Patent Publication Nos. 2007-014300, 2001-316462, and 03-180186, Japanese Patent Application Laid-Open No. 2003-048968, and Japanese Patent Application Laid-Open Nos. 2003-047494 and 07-255466, the entire disclosures each of which are incorporated herein by reference.

In embodiments, the polyhydroxyalkanoates may be obtained from the bacterium *Alcaligenes eutrophus. Alcaligenes eutrophus* may produce resins in beads with varying particle size of up to about 1 micron. Moreover, as disclosed in Wu, Corrinna, 1997, Sci. News. "Weight Control for bacterial plastics,' p. 23-25, vol. 151:2, the size of the resin can be controlled to less than about 250 nm in diameter.

In embodiments, the semi-crystalline resins described herein may have a particle size of less than about 250 nm in diameter, in embodiments from about 50 to about 250 nm in diameter, in other embodiments from about 75 to about 225 nm in diameter, although the particle size can be outside of these ranges.

The polyhydroxyalkanoate resins may be suitable for emulsion aggregation processes since they may be directly used to prepare toners without the need to use organic solvents to obtain resins of the desired, thus providing a more environmentally friendly process.

Commercial polyhydroxyalkanoates resins which may be utilized include BIOPOL™ (commercially available from Imperial Chemical Industries, Ltd (ICI), England), or those sold under the name MIREL™ in solid or emulsion form (commercially available from Metabolix).

In embodiments, the semi-crystalline resin may be present, for example, in an amount of from about 5 to about 25 percent by weight of the toner components, in embodiments from about 10 to about 20 percent by weight of the toner components, although the amount of semi-crystalline resin can be outside of these ranges. The semi-crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) using polystyrene standards of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000. The molecular weight distribution ($M_w/M_n$) of the crystalline resin may be, for example, from about 2 to about 6, in embodiments from about 3 to about 4.

In embodiments, suitable core resins which may be utilized include a semi-crystalline biodegradable polymeric resin described above in combination with an amorphous biodegradable polyester resin. The toner compositions may further include a wax, a pigment or colorant, and an optional coagulant. The toner particles may also include other conventional optional additives, such as colloidal silica (as a flow agent).

In embodiments, bio-based amorphous resins may include polyesters, polyamides, polyimides, polyisobutyrate, and polyolefins such as polyethylene, polybutylene, ethylene-propylene copolymers, ethylene-vinyl acetate copolymers, polypropylene, combinations thereof, and the like.

Examples of amorphous bio-based polymeric resins which may be utilized include polyesters derived from monomers including a fatty dimer acid or diol of soya oil, D-Isosorbide, and/or amino acids such as L-tyrosine and glutamic acid as described in U.S. Pat. Nos. 5,959,066; 6,025,061; 6,063,464; 6,107,447 and U.S. Patent Application Publication Nos. 2008/0145775 and 2007/0015075. Suitable amorphous bio-based resins include those commercially available from Advanced Image Resource, under the trade name BIOREZ™ 13062 and BIOREZ™ 15062.

The amorphous bio-based resin may be present, for example, in amounts of from about 50 to about 95 percent by weight of the toner components, in embodiments from about 65 to about 90 percent by weight of the toner components, although the amount of the amorphous bio-based resin can be outside of these ranges.

In embodiments, the amorphous bio-based polyester resin may have a particle size of from about 50 nm to about 250 nm in diameter, in embodiments from about 75 nm to 225 nm in diameter, although the particle size can be outside of these ranges.

In embodiments, suitable latex resin particles may include one or more of the polyhydroxyalkanoates resins, and one or more amorphous bio-based resins, such as BIOREZ™ described herein.

In embodiments, the amorphous bio-based resin or combination of amorphous resins utilized in the core may have a glass transition temperature of from about 40° C. to about 65° C., in embodiments from about 45° C. to about 60° C. In embodiments, the combined resins utilized in the core may have a melt viscosity of from about 10 to about 1,000,000 Pa*S at about 140° C., in embodiments from about 50 to about 100,000 Pa*S.

One, two, or more resins may be used. In embodiments where two or more resins are used, the resins may be in any suitable ratio (e.g., weight ratio) such as for instance of from about 10% (first resin)/90% (second resin) to about 90% (first resin)/10% (second resin).

Toner

The resins described above may be utilized to form toner compositions. Such toner compositions may include optional colorants, waxes, coagulants and other additives, such as surfactants. Toners may be formed utilizing any method within the purview of those skilled in the art.

Surfactants

In embodiments, colorants, waxes, and other additives utilized to form toner compositions may be in dispersions including surfactants. Moreover, toner particles may be formed by emulsion aggregation methods where the resin and other components of the toner are placed in one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the use of anionic and nonionic surfactants help stabilize the aggregation process in the presence of the coagulant, which otherwise could lead to aggregation instability.

In embodiments, the surfactant may be utilized so that it is present in an amount of from about 0.01% to about 5% by weight of the toner composition, for example from about 0.75% to about 4% by weight of the toner composition, in embodiments from about 1% to about 3% by weight of the toner composition, although the amount of surfactant can be outside of these ranges.

Examples of nonionic surfactants that can be utilized include, for example, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenc as IGEPAL CA-210™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ (alkyl phenol ethoxylate). Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, and acids such as abitic acid, which may be obtained from Aldrich, or NEOGEN R™, NEOGEN SC™, NEOGEN RK™ which may be obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof. An example of a suitable cationic surfactant may be SANIZOL B-50 available from Kao Corp., which consists primarily of benzyl dimethyl alkonium chloride.

Colorants

As the colorant to be added, various known suitable colorants, such as dyes, pigments, mixtures of dyes, mixtures of pigments, mixtures of dyes and pigments, and the like, may be included in the toner. The colorant may be included in the toner in an amount of, for example, about 0.1 to about 35 percent by weight of the toner, or from about 1 to about 15 weight percent of the toner, or from about 3 to about 10 percent by weight of the toner, although the amount of colorant can be outside of these ranges.

As examples of suitable colorants, mention may be made of carbon black like REGAL 330® (Cabot), Carbon Black 5250 and 5750 (Columbian Chemicals), Sunsperse Carbon Black LHD 9303 (Sun Chemicals); magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP-604™, NP-608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

In general, suitable colorants may include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD PS PA (Ugine Kuhlmann of Canada), Lithol Rubine Toner (Paul Uhlrich), Lithol Scarlet 4440 (BASF), NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASF), Paliotol Yellow 1840 (BASF), Novaperm Yellow FGL (Hoechst), Permanerit Yellow YE 0305 (Paul Uhlrich), Lumogen Yellow D0790 (BASF), Sunsperse Yellow YHD 6001 (Sun Chemicals), Suco-Gelb 1250 (BASF), Suco-Yellow D1355 (BASF), Suco Fast Yellow D1165, D1355 and D1351 (BASF), Hostaperm Pink E™ (Hoechst), Fanal Pink D4830 (BASF), Cinquasia Magenta™ (DuPont), Paliogen Black L9984 (BASF), Pigment Black K801 (BASF), Levanyl Black A-SF (Miles, Bayer), combinations of the foregoing, and the like.

Other suitable water based colorant dispersions include those commercially available from Clariant, for example, Hostafine Yellow GR, Hostafine Black T and Black TS, Hostafine Blue B2G, Hostafine Rubine F6B and magenta dry pigment such as Toner Magenta 6BVP2213 and Toner Magenta EO2 which may be dispersed in water and/or surfactant prior to use.

Specific examples of pigments include Sunsperse BHD 6011X (Blue 15 Type), Sunsperse BHD 9312X (Pigment Blue 15 74160), Sunsperse BHD 6000X (Pigment Blue 15:3 74160), Sunsperse GHD 9600X and GHD 6004X (Pigment Green 7 74260), Sunsperse QHD 6040X (Pigment Red 122 73915), Sunsperse RHD 9668X (Pigment Red 185 12516), Sunsperse RHD 9365X and 9504X (Pigment Red 57 15850: 1, Sunsperse YHD 6005X (Pigment Yellow 83 21108), Flexiverse YFD 4249 (Pigment Yellow 17 21105), Sunsperse YHD 6020X and 6045X (Pigment Yellow 74 11741), Sunsperse YHD 600X and 9604X (Pigment Yellow 14 21095), Flexiverse LFD 4343 and LFD 9736 (Pigment Black 7 77226), Aquatone, combinations thereof, and the like, as water based pigment dispersions from Sun Chemicals, Heliogen Blue L6900™, D6840™, D7080™, D7020™, Pylam Oil Blue™, Pylam Oil Yellow™, Pigment Blue 1™ available from Paul Uhlich & Company, Inc., Pigment Violet 1™, Pigment Red 48™, Lemon Chrome Yellow DCC 1026™, E.D. Toluidine Red™ and Bon Red C™ available from Dominion Color Corporation, Ltd., Toronto, Ontario, Novaperm Yellow FGL™, and the like. Generally, colorants that can be selected are black, cyan, magenta, or yellow, and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, and Anthrathrene Blue, identified in the Color Index as CI 69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL.

In embodiments, the colorant may include a pigment, a dye, combinations thereof, carbon black, magnetite, black, cyan, magenta, yellow, red, green, blue, brown, combinations thereof, in an amount sufficient to impart the desired color to the toner. It is to be understood that other useful colorants will become readily apparent based on the present disclosures.

In embodiments, a pigment or colorant may be employed in an amount of from about 1 weight percent to about 35 weight percent of the toner particles on a solids basis, in other embodiments, from about 5 weight percent to about 25 weight percent. However, amounts outside these ranges can also be used, in embodiments.

Wax

Optionally, a wax may also be combined with the resin and a colorant in forming toner particles. The wax may be provided in a wax dispersion, which may include a single type of wax or a mixture of two or more different waxes. A single wax may be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

When included, the wax may be present in an amount of, for example, from about 1 weight percent to about 25 weight percent of the toner particles, in embodiments from about 5 weight percent to about 20 weight percent of the toner particles, although the amount of wax can be outside of these ranges.

When a wax dispersion is used, the wax dispersion may include any of the various waxes conventionally used in emulsion aggregation toner compositions. Waxes that may be selected include waxes having, for example, a weight average molecular weight of from about 500 to about 20,000, in embodiments from about 1,000 to about 10,000. Waxes that may be used include, for example, polyolefins such as polyethylene including linear polyethylene waxes and branched polyethylene waxes, polypropylene including linear polypropylene waxes and branched polypropylene waxes, polyethylene/amide, polyethylenetetrafluoroethylene, polyethylenetetrafluoroethylene/amide, and polybutene waxes such as commercially available from Allied Chemical and Petrolite Corporation, for example POLYWAX™ polyethylene waxes such as commercially available from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as camauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax such as waxes derived from distillation of crude oil, silicone waxes, mercapto waxes, polyester waxes, urethane waxes; modified polyolefin waxes (such as a carboxylic acid-terminated polyethylene wax or a carboxylic acid-terminated polypropylene wax); Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, such as aliphatic polar amide functionalized waxes; aliphatic waxes consisting of esters of hydroxylated unsaturated fatty acids, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents. In embodiments, the waxes may be crystalline or non-crystalline.

In embodiments, the wax may be incorporated into the toner in the form of one or more aqueous emulsions or dispersions of solid wax in water, where the solid wax particle size may be in the range of from about 100 to about 300 nm.

Coagulants

Optionally, a coagulant may also be combined with the resin, a colorant and a wax in forming toner particles. Such coagulants may be incorporated into the toner particles during particle aggregation. The coagulant may be present in the toner particles, exclusive of external additives and on a dry weight basis, in an amount of, for example, from about 0 weight percent to about 5 weight percent of the toner particles, in embodiments from about 0.01 weight percent to about 3 weight percent of the toner particles, although the amount of coagulant can be outside of these ranges.

Coagulants that may be used include, for example, an ionic coagulant, such as a cationic coagulant. Inorganic cationic coagulants include, metal salts, for example, aluminum sulfate, magnesium sulfate, zinc sulfate, potassium aluminum sulfate, calcium acetate, calcium chloride, calcium nitrate, zinc acetate, zinc nitrate, aluminum chloride, and the like.

Examples of organic cationic coagulants include, for example, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quatemized polyoxyethylalkylamines, dodecylbenzyl triethyl ammonium chloride, and the like, and mixtures thereof.

Other suitable coagulants include, a monovalent metal coagulant, a divalent metal coagulant, a polyion coagulant, or the like. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum salts, such as aluminum sulphate and aluminum chlorides, polyaluminum halides such as polyaluminum fluoride and polyaluminum chloride (PAC), polyaluminum silicates such as polyaluminum sulfosilicate (PASS), polyaluminum hydroxide, polyaluminum phosphate, and the like.

Other suitable coagulants also include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, in embodiments, suitable polyaluminum compounds have from about 2 to about 13, in other embodiments, from about 3 to about 8, aluminum ions present in the compound.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in, for example, U.S. Pat. Nos. 5,290,654 and 5,302,486. In embodiments, toner compositions and toner particles may be prepared by aggregation and coalescence processes in which small-size resin particles are aggregated to the appropriate toner particle size and then coalesced to achieve the final toner-particle shape and morphology.

In embodiments, toner compositions may be prepared by an emulsion aggregation process that includes aggregating a mixture of an optional colorant, an optional wax, a coagulant, and any other desired or required additives, and emulsions including the resins described above, optionally in surfactants as described above, and then coalescing the aggregate mixture. A mixture may be prepared by adding a colorant and optionally a wax or other materials, which may also be optionally in a dispersion(s) including a surfactant, to the emulsion, which may be a mixture of two or more emulsions containing the resin. For example, emulsion/aggregation/coalescing processes for the preparation of toners are illustrated in the disclosure of the patents and publications referenced hereinabove.

The pH of the resulting mixture may be adjusted by an acid such as, for example, acetic acid, sulfuric acid, hydrochloric acid, citric acid, trifluro acetic acid, succinic acid, salicylic acid, nitric acid or the like. In embodiments, the pH of the mixture may be adjusted to from about 2 to about 5. In embodiments, the pH is adjusted utilizing an acid in a diluted form in the range of from about 0.5 to about 10 weight percent by weight of water, in other embodiments, in the range of from about 0.7 to about 5 weight percent by weight of water.

Examples of bases used to increase the pH and ionize the aggregate particles, thereby providing stability and preventing the aggregates from growing in size, can include sodium hydroxide, potassium hydroxide, ammonium hydroxide, cesium hydroxide and the like, among others.

Additionally, in embodiments, the mixture may be homogenized. If the mixture is homogenized, homogenization may be accomplished by mixing at about 600 to about 6,000 revolutions per minute. Homogenization may be accomplished by any suitable means, including, for example, an IKA ULTRA TURRAX T50 probe homogenizer.

Following the preparation of the above mixture, an aggregating agent may be added to the mixture. Any suitable aggregating agent may be utilized to form a toner. Suitable aggregating agents include, for example, aqueous solutions of a divalent cation or a multivalent cation material. The aggregating agent may be, for example, polyaluminum halides such as polyaluminum chloride (PAC), or the corresponding bromide, fluoride, or iodide, polyaluminum silicates such as polyaluminum sulfosilicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, zinc chloride, zinc bromide, magnesium bromide, copper chloride, copper sulfate, and combinations thereof. In embodiments, the aggregating agent may be added to the mixture at a temperature that is below the glass transition temperature (Tg) of the resin.

The aggregating agent may be added to the mixture utilized to form a toner in an amount of, for example, from about 0.1% to about 10% by weight, in embodiments from about 0.2% to about 8% by weight, in other embodiments from about 0.5% to about 5% by weight, of the resin in the mixture, although the amount of aggregating agent can be outside of these ranges.

The particles may be permitted to aggregate until a predetermined desired particle size is obtained. A predetermined desired size refers to the desired particle size to be obtained as determined prior to formation, and the particle size being monitored during the growth process until such particle size is reached. Samples may be taken during the growth process and analyzed, for example with a Coulter Counter, for average particle size. The aggregation thus may proceed by maintaining the elevated temperature, or slowly raising the temperature to, for example, from about 40° C. to about 100° C., and holding the mixture at this temperature for a time of from about 0.5 hours to about 6 hours, in embodiments from about hour 1 to about 5 hours, while maintaining stirring, to provide the aggregated particles. Once the predetermined desired particle size is reached, then the growth process is halted.

The growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example of from about 40° C. to about 90° C., in embodiments from about 45° C. to about 80° C., which may be below the glass transition temperature of the resin as discussed above.

Once the desired final size of the toner particles is achieved, the pH of the mixture may be adjusted with a base to a value of from about 3 to about 10, and in embodiments from about 5 to about 9. The adjustment of the pH may be utilized to freeze, that is to stop, toner growth. The base utilized to stop toner growth may include any suitable base such as, for example, alkali metal hydroxides such as, for example, sodium hydroxide, potassium hydroxide, ammonium hydroxide, combinations thereof, and the like. In embodiments, ethylene diamine tetraacetic acid (EDTA) may be added to help adjust the pH to the desired values noted above.

In embodiments, an emulsion aggregation process involves the formation of an emulsion latex of the resin particles, such as one or more of the polyhydroxyalkanoates resins described herein and resin particles of one or more of the amorphous bio-based resins described herein. The toner particles, in combination with additional ingredients used in emulsion aggregation toners (for example, one or more colorants, coagulants, additional resins, and/or waxes) may be heated to enable coalescence/fusing, thereby achieving aggregated, fused toner particles. In an embodiment, the emulsion aggregation process is carried out without the use of an organic solvent to obtain the desired particle size of the resin.

Shell Resin

In embodiments, after aggregation, but prior to coalescence, a resin coating may be applied to the aggregated particles to form a shell thereover. Any resin described above as suitable for forming the core resin may be utilized as the shell. In embodiments, a bio-based resin latex as described above may be included in the shell. In yet other embodiments, the bio-based latex described above may be combined with another resin and then added to the particles as a resin coating to form a shell.

In embodiments, resins which may be utilized to form a shell include, but are not limited to, a semi-crystalline polyester latex described above, and/or the amorphous resins described above for use as the core. In embodiments, an amorphous resin which may be utilized to form a shell in accordance with the present disclosure includes an amorphous bio-based polyester, optionally in combination with a semi-crystalline polyhydroxyalkanoate resin described above. For example, in embodiments, a semi-crystalline resin of Formula 1 above may be combined with an amorphous bio-based resin to form a shell. Multiple resins may be utilized in any suitable amounts. In embodiments, a first amorphous bio-based polyester resin, for example BIOREZ™, may be present in an amount of from about 20 percent by weight to about 100 percent by weight of the shell resin, in embodiments from about 30 percent by weight to about 90 percent by weight of the shell resin. Thus, in embodiments, a second resin may be present in the shell resin in an amount of from about 0 percent by weight to about 80 percent by weight of the shell resin, in embodiments from about 10 percent by weight to about 70 percent by weight of the shell resin, although the amount of the second resin can be outside of these ranges.

The shell resin may be applied to the aggregated particles by any method within the purview of those skilled in the art.

In embodiments, the resins utilized to form the shell may be in an emulsion including any surfactant described above. The emulsion possessing the resins, may be combined with the aggregated particles described above so that the shell forms over the aggregated particles. In embodiments, the shell may have a thickness of up to about 5 microns, in embodiments, of from about 0.1 to about 2 microns, in other embodiments, from about 0.3 to about 0.8 microns, over the formed aggregates.

The formation of the shell over the aggregated particles may occur while heating to a temperature of from about 30° C. to about 80° C., in embodiments from about 35° C. to about 70° C. The formation of the shell may take place for a period of time of from about 5 minutes to about 10 hours, in embodiments from about 10 minutes to about 5 hours.

For example, in some embodiments, the toner process may include forming a toner particle by mixing the polymer latexes, in the presence of a wax and a colorant dispersion, with an optional coagulant while blending at high speeds. The resulting mixture having a pH of, for example, of from about 2 to about 3, is aggregated by heating to a temperature below the polymer resin Tg to provide toner size aggregates. Optionally, additional latex can be added to the formed aggregates providing a shell over the formed aggregates. The pH of the mixture is then changed, for example by the addition of a sodium hydroxide solution, until a pH of about 7 is achieved.

Coalescence

Following aggregation to the desired particle size and application of any optional shell, the particles may then be coalesced to the desired final shape, the coalescence being achieved by, for example, heating the mixture to a temperature of from about 45° C. to about 100° C., in embodiments from about 55° C. to about 99° C., which may be at or above the glass transition temperature of the resins utilized to form the toner particles, and/or reducing the stirring, for example to from about 100 rpm to about 1,000 rpm, in embodiments from about 200 rpm to about 800 rpm. The fused particles can be measured for shape factor or circularity, such as with a Sysmex FPIA 2100 analyzer, until the desired shape is achieved.

Higher or lower temperatures may be used, it being understood that the temperature is a function of the resins used for the binder. Coalescence may be accomplished over a period of from about 0.01 to about 9 hours, in embodiments from about 0.1 to about 4 hours.

After aggregation and/or coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles may be optionally washed with water, and then dried. Drying may be accomplished by any suitable method for drying including, for example, freeze-drying.

Additives

In embodiments, the toner particles may also contain other optional additives, as desired or required. For example, the toner may include positive or negative charge control agents, for example in an amount of from about 0.1 to about 10 percent by weight of the toner, in embodiments from about 1 to about 3 percent by weight of the toner. Examples of suitable charge control agents include quaternary ammonium compounds inclusive of alkyl pyridinium halides; bisulfates; alkyl pyridinium compounds, including those disclosed in U.S. Pat. No. 4,298,672, the disclosure of which is hereby incorporated by reference in its entirety; organic sulfate and sulfonate compositions, including those disclosed in U.S. Pat. No. 4,338,390, the disclosure of which is hereby incorporated by reference in its entirety; cetyl pyridinium tetrafluoroborates; distearyl dimethyl ammonium methyl sulfate; aluminum salts such as BONTRON E84™ or E88™ (Orient Chemical Industries, Ltd.); combinations thereof, and the like. Such charge control agents may be applied simultaneously with the shell resin described above or after application of the shell resin.

There can also be blended with the toner particles external additive particles after formation including flow aid additives, which additives may be present on the surface of the toner particles. Examples of these additives include metal oxides such as titanium oxide, silicon oxide, aluminum oxides, cerium oxides, tin oxide, mixtures thereof, and the like; colloidal and amorphous silicas, such as AEROSIL®, metal salts and metal salts of fatty acids inclusive of zinc stearate, calcium stearate, or long chain alcohols such as UNILIN 700, and mixtures thereof.

In general, silica may be applied to the toner surface for toner flow, tribo enhancement, admix control, improved development and transfer stability, and higher toner blocking temperature. $TiO_2$ may be applied for improved relative humidity (RH) stability, tribo control and improved development and transfer stability. Zinc stearate, calcium stearate and/or magnesium stearate may optionally also be used as an external additive for providing lubricating properties, developer conductivity, tribo enhancement, enabling higher toner charge and charge stability by increasing the number of contacts between toner and carrier particles. In embodiments, a commercially available zinc stearate known as Zinc Stearate L, obtained from Ferro Corporation, may be used. The external surface additives may be used with or without a coating.

Each of these external additives may be present in an amount of from about 0.1 percent by weight to about 5 percent by weight of the toner, in embodiments of from about 0.25 percent by weight to about 3 percent by weight of the toner, although the amount of additives can be outside of these ranges. In embodiments, the toners may include, for example, from about 0.1 weight percent to about 5 weight percent titania, from about 0.1 weight percent to about 8 weight percent silica, and from about 0.1 weight percent to about 4 weight percent zinc stearate.

Suitable additives include those disclosed in U.S. Pat. Nos. 3,590,000, 3,800,588, and 6,214,507, the disclosures of each of which are hereby incorporated by reference in their entirety. Again, these additives may be applied simultaneously with the shell resin described above or after application of the shell resin.

In embodiments, toners of the present disclosure may be utilized as ultra low melt (ULM) toners. In embodiments, the dry toner particles having a core and/or shell may, exclusive of external surface additives, have one or more the following characteristics:

(1) Number Average Geometric Size Distribution (GSDn) and/or Volume Average Geometric Size Distribution (GSDv): In embodiments, the toner particles may have a very narrow particle size distribution with a lower number ratio GSD of from about 1.15 to about 1.38, in other embodiments, less than about 1.31. The toner particles of the present disclosure may also have a size such that the upper GSD by volume in the range of from about 1.20 to about 3.20, in other embodiments, from about 1.26 to about 3.11. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

(2) Shape factor of from about 105 to about 170, in embodiments, from about 110 to about 160, SF1*a. Scanning electron microscopy (SEM) may be used to determine the shape factor analysis of the toners by SEM and image analysis (IA). The average particle shapes are quantified by employing the following shape factor (SF1*a) formula: $SF1*a=100\pi d^2/(4A)$, where A is the area of the particle and d is its major axis. A perfectly circular or spherical particle has a shape factor of exactly 100. The shape factor SF1*a increases as the shape becomes more irregular or elongated in shape with a higher surface area.

(3) Circularity of from about 0.92 to about 0.99, in other embodiments, from about 0.94 to about 0.975. The instrument used to measure particle circularity may be an FPIA-2100 manufactured by Sysmex.

(4) Volume average diameter (also referred to as "volume average particle diameter") was measured for the toner particle volume and diameter differentials. The toner particles have a volume average diameter of from about 3 to about 25 μm, in embodiments from about 4 to about 15 μm, in other embodiments from about 5 to about 12 μm.

The characteristics of the toner particles may be determined by any suitable technique and apparatus and are not limited to the instruments and techniques indicated hereinabove.

In embodiments, the toner particles may have a weight average molecular weight (Mw) in the range of from about 17,000 to about 60,000 daltons, a number average molecular weight (Mn) of from about 9,000 to about 18,000 daltons, and a MWD (a ratio of the Mw to Mn of the toner particles, a measure of the polydispersity, or width, of the polymer) of from about 2.1 to about 10. For cyan and yellow toners, the toner particles in embodiments can exhibit a weight average molecular weight (Mw) of from about 22,000 to about 38,000 daltons, a number average molecular weight (Mn) of from about 9,000 to about 13,000 daltons, and a MWD of from about 2.2 to about 10. For black and magenta, the toner particles in embodiments can exhibit a weight average molecular weight (Mw) of from about 22,000 to about 38,000 daltons, a number average molecular weight (Mn) of from about 9,000 to about 13,000 daltons, and a MWD of from about 2.2 to about 10.

Further, the toners if desired can have a specified relationship between the molecular weight of the latex binder and the molecular weight of the toner particles obtained following the emulsion aggregation procedure. As understood in the art, the binder undergoes crosslinking during processing, and the extent of crosslinking can be controlled during the process. The relationship can best be seen with respect to the molecular peak values (Mp) for the binder which represents the highest peak of the Mw. In the present disclosure, the binder can have a molecular peak (Mp) in the range of from about 22,000 to about 30,000 daltons, in embodiments, from about 22,500 to about 29,000 daltons. The toner particles prepared from the binder also exhibit a high molecular peak, for example, in embodiments, of from about 23,000 to about 32,000, in other embodiments, from about 23,500 to about 31,500 daltons, indicating that the molecular peak is driven by the properties of the binder rather than another component such as the colorant.

Toners produced in accordance with the present disclosure may possess excellent charging characteristics when exposed to extreme relative humidity (RH) conditions. The low-humidity zone (C zone) may be about 12° C./15% RH, while the high humidity zone (A zone) may be about 28° C./85% RH. Toners of the present disclosure may possess a parent toner charge per mass ratio (Q/M) of from about −2 μC/g to about −28 μC/g, in embodiments from about =4 μC/g to about −25 μC/g, and a final toner charging after surface additive blending of from −8 μC/g to about −25 μC/g, in embodiments from about −10 μC/g to about −22 μC/g.

Developer

The toner particles may be formulated into a developer composition. For example, the toner particles may be mixed with carrier particles to achieve a two-component developer composition. The carrier particles can be mixed with the toner particles in various suitable combinations. The toner concentration in the developer may be from about 1% to about 25% by weight of the developer, in embodiments from about 2% to about 15% by weight of the total weight of the developer. In embodiments, the toner concentration may be from about 90% to about 98% by weight of the carrier. However, different toner and carrier percentages may be used to achieve a developer composition with desired characteristics.

Carriers

Illustrative examples of carrier particles that can be selected for mixing with the toner composition prepared in accordance with the present disclosure include those particles that are capable of triboelectrically obtaining a charge of opposite polarity to that of the toner particles. Accordingly, in one embodiment the carrier particles may be selected so as to be of a negative polarity in order that the toner particles that are positively charged will adhere to and surround the carrier particles. Illustrative examples of such carrier particles include granular zircon, granular silicon, glass, silicon dioxide, iron, iron alloys, steel, nickel, iron ferrites, including ferrites that incorporate strontium, magnesium, manganese, copper, zinc, and the like, magnetites, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include polyolefins, fluoropolymers, such as polyvinylidene fluoride resins, terpolymers of styrene, acrylic and methacrylic polymers such as methyl methacrylate, acrylic and methacrylic copolymers with fluoropolymers or with monoalkyl or dialkylamines, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 weight % to about 70 weight %, in embodiments from about 40 weight % to about 60 weight %. The coating may have a coating weight of, for example, from about 0.1 weight % to about 5% by weight of the carrier, in embodiments from about 0.5 weight % to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 weight % to about 10 weight %, in embodiments from about 0.01 weight % to about 3 weight %, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

Toners of the present disclosure may be utilized in electrostatographic (including electrophotographic) or xerographic imaging methods, including those disclosed in, for example, U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with a xerographic device including a charging component, an imaging component, a photoconductive component, a developing component, a transfer component, and a fusing component. In embodiments, the development component may include a developer prepared by mixing a carrier with a toner composition described herein. The xerographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 70° C. to about 160° C., in embodiments from about 80° C. to about 150° C., in other embodiments from about 90° C. to about 140° C., after or during melting onto the image receiving substrate.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

Preparation of the semi-crystalline resin poly(3-hydroxyheptanoic acid-co-3-hydroxynonanoic acid (P(HHp-co-HN).

A polyhydroxyalkanoates latex emulsion of a co-polyester containing randomly arranged units of a semi-crystalline resin poly(3-hydroxyheptanoic acid-co-3-hydroxynonanoic acid (P(HHp-co-HN)) as depicted in Formula I (R=$C_7$ & $C_9$) was obtained via fermentation of bacteria, specifically *Alcaligenes eutrophus*, commercially available from Polyferm Canada, supplied with two carbon sources under nutrient limited conditions. The seed culture was incubated and agitated within a nutrient-rich medium containing about 10 g/L glucose, about 1 g/L $(NH_4)_2SO_4$, about 0.2 g/L $MgSO_4.7H_2O$, about 1.5 g/L $KH_2PO_4$, about 9 g/L $Na_2HPO_4.12H_2O$, and about 1 mL/L trace element solution (10 g/L $FeSO_4.7H_2O$, about 2.25 g/L $ZnSO_4.7H_2O$, about 1 g/L $CuSO_4.7H_2O$, about 0.5 g/L $MnSO_4.5H_2O$, about 2 g/L $CaCl_2.2H_2O$, about 0.23 g/L $Na_2B_4O_7.7H_2O$, about 0.1 g/L $(NH_4)_6Mo_7O_{24}$, and about 10 mL/L 35% HCl). Exponentially growing cells were harvested from a container to inoculate the bioreactor for the fed-batch culture. Initial agitation speed and air flow rate were about 300 rpm and at about 2 L/min, respectively. During cultivation, agitation and aeration maintained the dissolved oxygen concentration above about 40% air saturation. Similarly to the seed culture, temperature and pH were strictly controlled within the bacteria's optimal range for growth, at temperatures of about 34° C. and pH of about 6.8. The pH was maintained with a 2N HCl solution and a 28% $NH_4OH$ solution. The reactor medium, included about 20 g/L glucose, about 4 g/L $(NH_4)_2SO_4$, about 1.2 g/L $MgSO_4.7H_2O$, about 1.7 g/L citric acid and about 10 mL/L trace element solution, was initially added in an amount of about 5.5 g/L $KH_2PO_4$, calculated to give a particular dry weight of cells. At the point of nutrient limitation, a feed solution of about 132 g/L glucose and about 18 g/L propionic acid was added. At the completion of the fermentation, the semi-crystalline copolyester was harvested.

The entire non-solvent based recovery procedure was performed within the fermenter, and involved the solubilization of biomass and subsequent filtration to yield latex as the final product, known as the enzymatic digestion method. The reactor temperature was increased up to sterilization temperature, of about 121° C., to kill cells, followed by rapid cooling to about 55° C. The pH was adjusted and maintained at about 8.5 and an excess of protease (Alcalase), EDTA, and SDS were added. After 30 minutes, the sterile recirculation loop containing a 0.1 μm filter was connected and diafiltration commenced. Water was added to maintain a constant volume according to the filtrate output and pressurized air supplied regular back flushing on the filtrate outlet. The process of the diafiltration was monitored via spectrophotometry. The filtrate was initially yellow and showed an absorbance at about 350 nm. The water supply was disconnected when the absorbance of the filtrate was negligible. Diafiltration became common filtration until the retentate was concentrated to about 300 g/L. The latex was harvested from the recirculation loop with particles having an average size of about 205 nm. The emulsion was adjusted to about 20% solids.

Example 2

Preparation of an Amorphous Biodegradable Resin Emulsion by a Phase Inversion Process.

To a 1 liter kettle, equipped with an oil bath, distillation apparatus and mechanical stirrer, about 100 grams of an amorphous bio-based resin BIOREZ™ 13062, commercially available from Advanced Image Resource, was added, and exhibited a glass transition temperature of about 52° C. and an acid value of about 16. About 140 grams of methyl ethyl ketone and about 15 grams of isopropanol was added to the resins. The mixture was stirred at about 350 revolutions per minute (rpm), heated to about 55° C. over about a 30 minute period, and maintained at about 55° C. for about an additional 3 hours, whereby the resin dissolved to obtain a clear solution. To this solution, about 9 grams of ammonium hydroxide was added dropwise over about a two minute period. The solution was stirred for about an additional 10 minutes at about 350 rpm. About 600 grams of water was added dropwise at a rate of about 4.3 grams per minute utilizing a pump. The organic solvent was removed by distillation at about 84° C., and the mixture was then cooled to room temperature (from about 20° C. to about 25° C.) to yield about a 35% solids loading of an aqueous emulsion nanoparticles with an average size of about 163 nm.

Example 3

Preparation of an Emulsion Aggregation Toner including about 14 percent by weight of the semi-crystalline biodegradable resin of Example 1, about 84.2 percent by weight of the amorphous biodegradable resin of Example 2, and about 3.8 percent by weight of Cyan pigment Pigment Blue 15:3.

The semi-crystalline biodegradable resin from Example 1 in an emulsion (about 14 weight % resin) was weighed out into a 2 L glass reaction vessel. The amorphous biodegradable resin from Example 2 in an emulsion (about 84.2 weight % resin) was weighed into the 2 L glass reaction vessel. About 3.8% of the cyan pigment was added to the resins. An anionic surfactant, an alkyldiphenyloxide disulfonate salt commercially available as DOWFAX™ (from Dow Chemical Company), was added to the resin mixture such that the surfactant to core resin ratio was about 2.5 pph. The pH of the resin mixture was then adjusted to about 3.4 using 0.3M $HNO_3$.

Homogenization of the solution in the 2 liter glass reaction vessel was commenced using an IKA Ultra Turrax T50 homogenizer by mixing the mixture at about 3500 rpm.

A coagulant, such as $Al_2(SO_4)_3$ solution, was added to the resin mixture during homogenization such that the Al to toner ratio was about 0.19 pph. The mixture was subsequently transferred to a 2 liter Buchi reactor, and heated to about 42° C. for about 4 hours to permit aggregation and mixed at a speed of about 700 rpm. The particle size was monitored with a Coulter Counter until the core particles reached a volume average particle size of about 6.83 μm with a GSD of about 1.25.

Thereafter, the pH of the reaction slurry was increased to about 7.2 by adding VERSENE™ EDTA chelating agent and 1M NaOH to freeze, that is stop, the toner growth. The amount of VERSENE™ added was such that the EDTA to toner ratio was about 0.34 pph, at a pH of about 4. After stopping the toner growth, the reaction mixture was heated to about 85° C. and kept at that temperature for about 75 minutes for coalescence. A pH of about 7.2 was maintained as the temperature increased to about 68° C., after which point the pH was allowed to drift downward. At about 80° C., a buffer was added (1 drop every 5 sec) to further drop the pH to about 7.1.

When a circularity of greater than about 0.96 was achieved, the mixture was cooled to room temperature. The resulting EA toner particles were recovered by washing four times, each for about 60 minutes, in de-ionized water and then freeze dried for two days to yield a size of about 13 microns with a GSD of about 1.31.

Charging/Relative Humidity Sensitivities

Developer samples were prepared in a 60 milliliter glass bottle by weighing about 0.5 gram of toner onto about 10 grams of carrier which included a steel core and a coating of a polymer mixture of polymethylmethacrylate (PMMA, 60 wt. %) and polyvinylidene fluoride (40 wt. %). Developer samples were prepared in duplicate as above for each toner that was being evaluated. One sample of the pair was conditioned in the A-zone environment of 28° C./85 wt % relative humidity (RH), and the other was conditioned in the C-zone environment of 10° C./15 wt % RH. The samples were kept in the respective environments overnight, about 18 to about 21 hours, to fully equilibrate. The following day, the developer samples were mixed for about 1 hour using a Turbula mixer, after which the charge on the toner particles was measured using a charge spectrograph. The toner charge was calculated as the midpoint of the toner charge distribution. The charge was in millimeters of displacement from the zero line for both the parent particles and particles with additives. The RH ratio was calculated as the A-zone charge at 85 wt % humidity (in millimeters) over the C-zone charge at 15 wt % humidity (in millimeters). For the toner of Example 3, the triboelectric charge in the A-zone environment was about −9 μC/g, the triboelectric charge in the C-zone environment was about −23 μC/g and the RH sensitivity ratio was found to be about 0.39.

Gloss/Crease Fix

Unfused test images were made using a Xerox Corporation DC12 color copier/printer. Images were removed from the Xerox Corporation DC12 before the document passed through the fuser. These unfused test samples were then fused using a Xerox Corporation iGen3® fuser. Test samples were directed through the fuser using the Xerox Corporation iGen3® process conditions (100 prints per minute). Fuser roll temperature was varied during the experiments so that gloss and crease area could be determined as a function of the fuser roll temperature. Print gloss was measured using a BYK Gardner 75° gloss meter. How well toner adheres to the paper was determined by its crease fix minimum fusing temperature (MFT). The fused image was folded and about 860 g weight of toner was rolled across the fold after which the page was unfolded and wiped to remove the fractured toner from the sheet. This sheet was then scanned using an Epson flatbed scanner and the area of toner which had been removed from the paper was determined by image analysis software such as the National Instruments IMAQ. For the toner of Example 3, the minimum fixing temperature was about 158° C., the hot-offset temperature was about 210° C., the fusing latitude was about 60° C., and the peak gloss was about 65.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner consisting essentially of a core of a biodegradable semi-crystalline polyester resin and a bio-based amorphous polyester resin; a shell with a thickness of from about 0.1 to about 5 microns of a biodegradable semi-crystalline polyester; and optionally, one or more ingredients selected from the group consisting of colorants, waxes, coagulants, and combinations thereof and wherein the amorphous biodegradable polyester resin is derived from a bio-based material selected from the group consisting of polylactide, polycaprolactone, polyesters derived from D-Isosorbide, polyesters derived from a fatty dimer diol, polyesters derived from a dimer diacid, L-tyrosine, glutamic acid, and combinations thereof.

2. The toner of claim 1, wherein the semi-crystalline biodegradable polyester resin comprises a polyhydroxyalkanoate of the following formula:

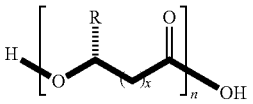

wherein R is H, a substituted alkyl group, or an unsubstituted alkyl group having from about 1 to about 13 carbon atoms, X is from about 1 to about 3, and n is from about 50 to about 10,000.

3. The toner of claim 2, wherein the polyhydroxyalkanoate is selected from the group consisting of polyhydroxybutyrate, polyhydroxyvalerate, copolyesters containing randomly arranged units of 3-hydroxybutyrate and 3-hydroxyvalerate, and combinations thereof.

4. The toner of claim 1, wherein said semi-crystalline polyester resin is produced by a bacterium which includes *Alcaligenes eutrophus*.

5. The toner of claim 1, wherein the biodegradable polyester resin has a particle size of from about 50 nm to about 250 nm in diameter.

6. The toner of claim 1, wherein the biodegradable semi-crystalline polyester resin is present in the toner in an amount of from about 5 percent to about 25 percent by weight of the toner.

7. The toner of claim 1, wherein the coagulant is selected from the group consisting of aluminum salts, polyaluminum halides, polyaluminum silicates, polyaluminum hydroxides, polyaluminum phosphates, and combinations thereof, the wax is selected from the group consisting of a polyethylene wax, a polypropylene wax, and combinations thereof, and is present in an amount of from about 5 percent to about 15 percent by weight of the toner, and the colorant includes a pigment, a dye, and combinations thereof, in an amount of from about 1 percent to about 25 percent by weight of the toner.

8. A toner consisting of:

a core of at least one biodegradable semi-crystalline polyester resin of a polyhydroxyalkanoate selected from the group consisting of polyhydroxybutyrate, polyhydroxyvalerate, copolyesters containing randomly arranged units of 3-hydroxybutyrate and 3-hydroxyvalerate, and combinations thereof; and at least one bio-based amorphous polyester resin derived from a bio-based material selected from the group consisting of polylactide, polycaprolactone, polyesters derived from D-Isosorbide, polyesters derived from a fatty dimer diol, polyesters derived from a dimer diacid, L-tyrosine, glutamic acid, and combinations thereof;

a shell present on said core, and which shell consists of said biodegradable semi-crystalline polyester resin, said bio-based amorphous polyester resin, or mixtures thereof; and one or more ingredients selected from the group consisting of colorants, waxes, coagulants, and combinations thereof.

9. The toner of claim 8, wherein the polyhydroxyalkanoate is of the following formula:

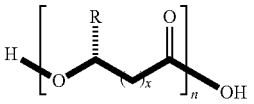

wherein R is H, a substituted alkyl group, or an unsubstituted alkyl group having from about 1 to about 13 carbon atoms, X is from about 1 to about 3, and n is from about 50 to about 10,000.

10. The toner of claim 8, wherein said semi-crystalline polyester resin is produced by a bacterium which includes *Alcaligenes eutrophus*.

11. The toner of claim 8, wherein the biodegradable polyester resin has a particle size of from about 50 nm to about 250 nm in diameter and is present in the toner particles in an amount of from about 5 percent to about 25 percent by weight of the toner particles.

12. The toner of claim 8, wherein the coagulant is selected from the group consisting of aluminum salts, polyaluminum halides, polyaluminum silicates, polyaluminum hydroxides, polyaluminum phosphates, and combinations thereof, the wax is selected from the group consisting of a polyethylene wax, a polypropylene wax, and combinations thereof, and is present in an amount of from about 5 percent to about 15 percent by weight of the toner, and the colorant includes a pigment, a dye, and combinations thereof, in an amount of from about 1 percent to about 25 percent by weight of the toner.

13. A toner composition consisting of a core of a mixture of biodegradable semi-crystalline polyester resin of a polyhydroxyalkanoate selected from the group consisting of polyhydroxybutyrate, polyhydroxyvalerate, and copolyesters containing randomly arranged units of 3-hydroxybutyrate and 3-hydroxyvalerate, and a bio-based amorphous polyester resin derived from a bio-based material selected from the group consisting of polylactide, polycaprolactone, polyesters derived from D-Isosorbide, polyesters derived from a fatty dimer diol, polyesters derived from a dimer diacid, L-tyrosine, glutamic acid, and mixtures thereof; a shell present on said core and which shell consists of said biodegradable semi-crystalline polyester resin, said bio-based amorphous polyester resin, or mixtures thereof; and a component selected from the group consisting of colorants, waxes, and mixtures thereof.

* * * * *